US012163097B2

(12) United States Patent
Wang et al.

(10) Patent No.: US 12,163,097 B2
(45) Date of Patent: Dec. 10, 2024

(54) EFFICIENT CRACKING FURNACE SYSTEM WITH REDUCED EMISSION OF CO2

(71) Applicant: TECHNIP ENERGIES FRANCE, Nanterre (FR)

(72) Inventors: Yong Wang, Houston, TX (US); Fanxu Meng, Cypress, TX (US); Joel Guillaume, Houston, TX (US)

(73) Assignee: TECHNIP ENERGIES FRANCE, Nanterre (FR)

( * ) Notice: Subject to any disclaimer, the term of this patent is extended or adjusted under 35 U.S.C. 154(b) by 0 days.

(21) Appl. No.: 18/062,568

(22) Filed: Dec. 6, 2022

(65) Prior Publication Data

US 2024/0182795 A1 Jun. 6, 2024

(51) Int. Cl.
*C10G 9/36* (2006.01)
*C10G 9/00* (2006.01)
*C10G 9/20* (2006.01)

(52) U.S. Cl.
CPC ..... *C10G 9/36* (2013.01); *C10G 9/002* (2013.01); *C10G 9/206* (2013.01); (Continued)

(58) Field of Classification Search
CPC . C10G 9/002; C10G 9/18; C10G 9/20; C10G 9/206; C10G 9/36
See application file for complete search history.

(56) References Cited

U.S. PATENT DOCUMENTS

2020/0172814 A1* 6/2020 Oud ..... C10G 9/18
2021/0048193 A1* 2/2021 Oud ..... F23D 14/64

FOREIGN PATENT DOCUMENTS

EP 3415587 A1 12/2018
EP 4056894 A1 9/2022
(Continued)

OTHER PUBLICATIONS

International Search Report and Written Opinion, of the European Patent Office, as ISA, mailed May 22, 2024, in corresponding International Patent Application PCT/IB2023/000784.

*Primary Examiner* — Renee Robinson
(74) *Attorney, Agent, or Firm* — Locke Lord LLP; Gabrielle L. Gelozin; Christopher J. Capelli

(57) ABSTRACT

A cracking furnace system for converting a hydrocarbon feedstock into cracked gas includes a convection section, a radiant section and a cooling section. The convection section includes a plurality of convection banks configured to receive only a hydrocarbon feedstock and a diluent. The radiant section includes a firebox comprising at least oxygen or oxygen enriched air burners and several radiant coils configured to heat up the feedstock to a temperature allowing a pyrolysis reaction. The cooling section includes at least two transfer line exchangers (TLE), a primary transfer line exchanger (PTLE) and a secondary transfer line exchanger (STLE). The system includes a mixing device for mixing the preheated hydrocarbon feedstock and the preheated diluent. The system is configured such that the hydrocarbon feedstock and diluent mixture is preheated in the secondary transfer line exchanger before entry into the radiant section. The primary transfer line exchanger is configured to generate saturated steam. The system includes a steam drum which is connected to the primary transfer line exchanger.

18 Claims, 1 Drawing Sheet

(52) U.S. Cl.
CPC ..... *C10G 2300/4006* (2013.01); *C10G 2300/4043* (2013.01); *C10G 2300/807* (2013.01); *C10G 2400/20* (2013.01)

(56) References Cited

FOREIGN PATENT DOCUMENTS

| | | | |
|---|---|---|---|
| WO | 2021016301 | A1 | 1/2021 |
| WO | 2021156748 | A1 | 8/2021 |

* cited by examiner

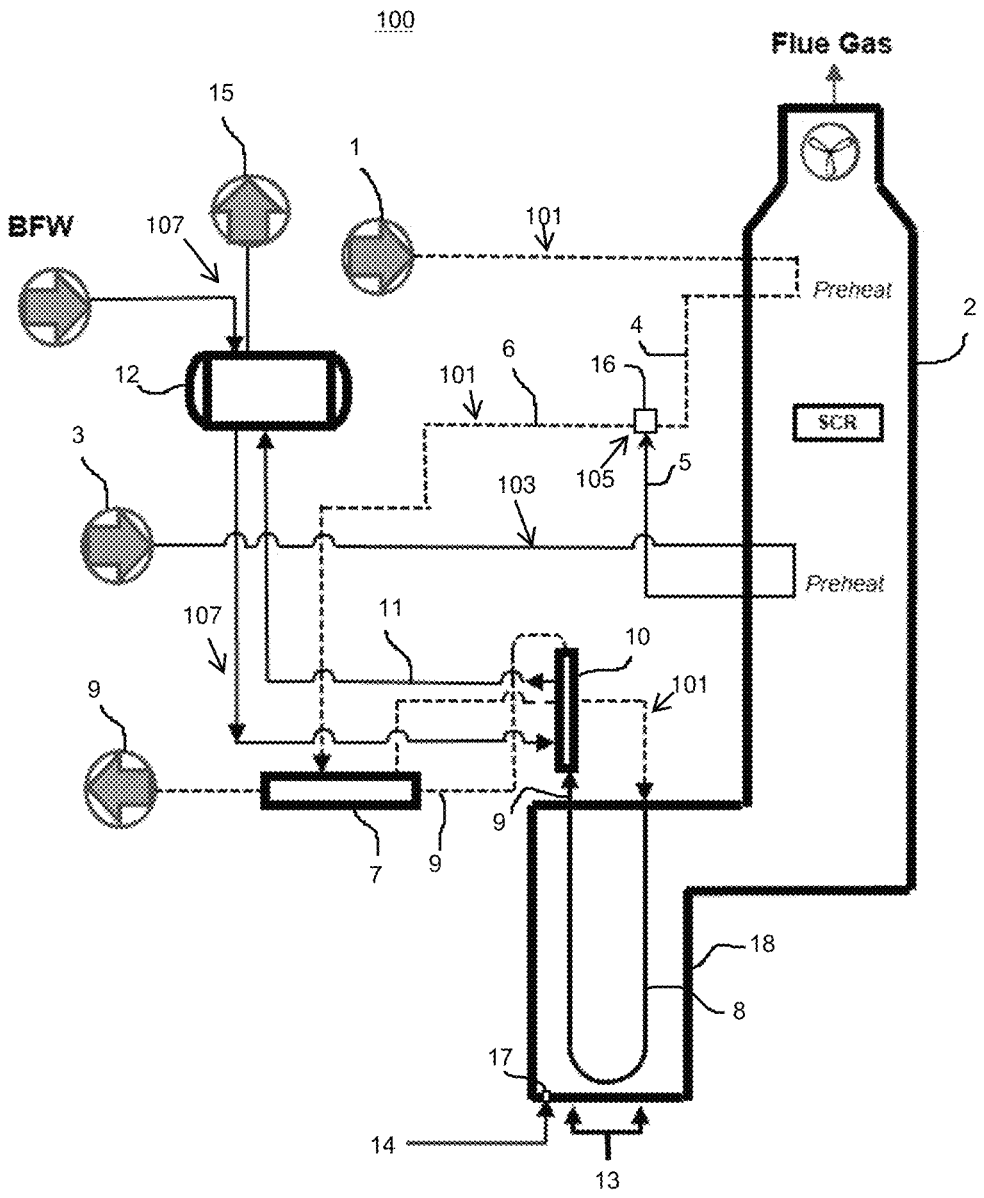
100
Flue Gas
15
1
BFW
107
101
Preheat
2
4
6
16
12
101
SCR
3
105
5
103
Preheat
107
11
10
9
101
9
7
9
18
8
17
14
13

EFFICIENT CRACKING FURNACE SYSTEM WITH REDUCED EMISSION OF CO2

BACKGROUND

Field

The present invention relates to a cracking furnace system for converting a hydrocarbon feedstock into cracked gas and a method for cracking hydrocarbon feedstock therein.

Description of Related Art

A conventional cracking furnace system, as is for example disclosed in document U.S. Pat. No. 4,479,869, generally comprises a convection section, in which hydrocarbon feedstock is preheated and/or partly evaporated and mixed with dilution steam to provide a feedstock-dilution steam mixture. The system also comprises a radiant section, including at least one radiant coil in a firebox, in which the feedstock-dilution steam mixture 6 from the convection section is converted into product and by-product components at high temperature by pyrolysis. The system further comprises a cooling section including at least one quench exchanger, for example a transfer line exchanger, configured to quickly quench the product or cracked gas leaving the radiant section in order to stop pyrolysis side reactions, and to preserve the equilibrium of the reactions in favor of the products. Heat from the transfer line exchanger can be recovered in the form of high-pressure steam.

A drawback of the known systems is that a lot of fuel needs to be supplied for the pyrolysis reaction.

Carbon capture and storage (CCS) is a commercial method to help the petrochemical companies to achieve carbon neutral. CCS is an expensive approach because it handles a large quantity of flue gas and uses amine to extract CO2 out of nitrogen. Oxyfuel combustion is a solution to dramatically reduce the flue gas quantity. Oxygen can be generated from air separation unit or water electrolyser. With oxyfuel combustion, the flue gas contains 64 mol % water and 30 mol % CO2. The rest is a small portion of excess O2 and N2 inert gases. Because the combustion heat is not used to heat up the huge amount of inert gas such as N2, the fuel gas consumption can be reduced by approximately 30%. Overall, the flue gas mass flow rate is reduced by more than 80%. This can significantly reduce CCS plant size and simplify the CO2 separation process. However, this poses new challenge on ethylene cracking furnace design.

Convectional ethylene furnace provides the heat for steam cracking reactions and the heat to generate super high-pressure steam. Pure oxyfuel combustion without any additional inert gas or inert gas external recirculation dramatically reduces the available heat. There is no sufficient heat to provide the cracking heat in the radiant section and raise the hydrocarbon and dilution steam temperature to the target crossover temperature.

Such conventional methods and systems have generally been considered satisfactory for their intended purpose. However, there is still a need in the art for more efficient cracking furnace systems with a reduced need for energy supply, and consequently, a reduced emission of CO2. The present disclosure provides a solution for this need.

SUMMARY

A cracking furnace system for converting a hydrocarbon feedstock into cracked gas, the cracking furnace system includes a convection section, a radiant section, a cooling section and a steam drum. The convection section includes a plurality of convection banks configured to receive only a hydrocarbon feedstock and a diluent. The radiant section includes a firebox comprising at least oxygen or oxygen enriched air burners and several radiant coils configured to heat up the feedstock to a temperature allowing a pyrolysis reaction, wherein the cooling section includes at least two transfer line exchangers (TLE): a primary transfer line exchanger (PTLE) and a secondary transfer line exchanger (STLE). The system further comprising mixing device configured and adapted to mix the preheated hydrocarbon feedstock and the preheated diluent. The system is configured such that the hydrocarbon feedstock and diluent mixture is preheated in the secondary transfer line exchanger before entry into the radiant section. The primary transfer line exchanger is configured to generate saturated steam. The steam drum is connected to the primary transfer line exchanger.

In some embodiments, the diluent can be dilution steam. In certain embodiments, the surface area of the radiant coil in the radiant section can be comprised of serpentine coils. It is contemplated that the cooling section can include a tertiary transfer line exchanger. The radiant section comprises oxyfuel burners. The cracking furnace system can include a flame temperature control device in the radiant section. The flame temperature control device can include high velocity jets to introduce fuel and oxygen or oxygen enriched air in the radiant section. In some embodiments, the convection section does not comprise utility banks such as boil feed water economizer bank and super high pressure steam superheating banks configured to generate superheated steam.

A method for cracking hydrocarbon feedstock in a cracking furnace system includes preheating a feedstock in a convection section at a temperature between 50° C. and 180° C., mixing the hydrocarbon feedstock after preheating with a diluent to form a mixed feedstock-diluent, preheating the mixed feedstock-diluent in a secondary transfer line exchanger at a temperature between 250° C. and 700° C., and cracking the mixed feedstock-diluent after preheating in the radiant section by oxygen or oxygen enriched air combustion to produce cracked gas. The method includes cooling the cracked gas in the primary transfer line exchanger (PTLE), cooling the cracked gas exiting the primary transfer line exchanger (PTLE) further in the secondary transfer line exchanger (STLE), producing a saturated super high-pressure steam in the PTLE.

In certain embodiments, the saturated super high-pressure steam is generated from water coming from a steam drum. In some embodiments, the saturated super high-pressure steam produced is sent into a steam drum. The diluent can be dilution steam. The dilution steam can be produced outside the cracking furnace system. In accordance with some embodiments, cracking the mixed feedstock-diluent comprises controlling a combustion temperature in the radiant section by dilution of fuel and oxygen or oxygen enriched air. The oxygen enriched air can comprise more than 21% oxygen. Cracking the mixed feedstock-diluent can include producing flue gas at a temperature between 950° C. and 1300° C. and sending the flue gas to the convection section. The method can include cracking the mixed feedstock-diluent includes producing flue gas at a temperature between 1000° C. and 1150° C. Preheating the feedstock in the convection section can include preheating the feedstock in the convection section at a temperature between 150° C. and 160° C. Preheating the mixed feedstock-diluent in the secondary transfer line exchanger can include preheating the mixed feedstock-diluent in the secondary transfer line exchanger at a temperature between 275° C. and 500° C.

In accordance with at least one aspect of this disclosure, a cracking furnace system for converting a hydrocarbon feedstock into cracked gas is provided. The cracking furnace system includes a first flow path for flowing a hydrocarbon feedstock through the cracking furnace and a second flow path for flowing a diluent through the cracking furnace.

A convection section is disposed in the first flow path and the second flow path configured to receive only a hydrocarbon feedstock and a diluent to preheat the hydrocarbon feedstock and the diluent. A mixing device is disposed in the first flow path and the second flow path at a junction downstream of the convention section configured and adapted to mix the preheated hydrocarbon feedstock and the preheated diluent to generate a feedstock-diluent mixture.

A radiant section is disposed in the first flow path downstream of the mixing device, the radiant section having a firebox, the firebox comprising one or more pure oxygen burners and a plurality of serpentine radiant coils configured to heat the feedstock-diluent mixture to a temperature allowing a pyrolysis reaction. A cooling section having a first transfer line exchanger a second transfer line exchanger is also provided in at least the first flow path, The first transfer line exchanger is disposed in the first flow path downstream of the radiant section, and the second transfer line exchanger is disposed in the first flow path upstream of the radiant section and downstream of the radiant section such that the feedstock-diluent mixture is preheated in the second transfer line exchanger with cracked gas exiting the radiant section before the feedstock-diluent mixture enters into the radiant section and the cracked gas exiting the radiant section is cooled with the feedstock-diluent mixture in the second transfer line exchanger.

The cracking furnace system further includes a third flow path for flowing steam within the cracking furnace, the first transfer line exchanger is disposed in the second flow path and the first flow path for generating steam. A steam drum is disposed in the third flow path for receiving steam from the first transfer line exchanger. In certain embodiments, there is no boiler feed water bank in the convection section. As such, the boiler water can be provided directly to the steam drum via the third flow path and wherein steam produced at the first transfer line exchanger is provided directly to the steam drum via the third flow path.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIG. 1 shows a schematic representation of a cracking furnace system according to a preferred embodiment of the invention.

DETAILED DESCRIPTION

Reference will now be made to the drawing wherein like reference numerals identify similar structural features or aspects of the subject disclosure. For purposes of explanation and illustration, and not limitation, an exemplary embodiment of a cracking furnace system for converting a hydrocarbon feedstock in accordance with the disclosure is shown in FIG. 1 and is designated generally by reference character 100. A solution of the present invention is a cracking furnace system 100 for converting a hydrocarbon feedstock 1 into cracked gas 9 comprising a convection section 2, a radiant section and a cooling section, wherein the convection section 2 includes a plurality of convection banks configured to receive only a hydrocarbon feedstock 1 and a diluent 3, Wherein the radiant section includes a firebox comprising at least oxygen or oxygen enriched air burners and several radiant coils 8 configured to heat up the feedstock to a temperature allowing a pyrolysis reaction, Wherein the cooling section includes at least two transfer line exchangers (TLE): a primary transfer line exchanger (PTLE) 10 and a secondary transfer line exchanger (STLE) 7, Wherein the system further comprising a mixing device, e.g. a mixing tee, or the like, configured and adapted to mix the preheated hydrocarbon feedstock 4 and the preheated diluent 5, Wherein the system is configured such that the hydrocarbon feedstock and diluent mixture 6 is preheated in the secondary transfer line exchanger 7 before entry into the radiant section, Wherein the primary transfer line exchanger 10 is configured to generate saturated steam 11, the system further comprising a steam drum 12 which is connected to the primary transfer line exchanger 10.

The optimum inlet temperature of the feedstock into the radiant section is determined by the thermal stability of the feedstock, as is known to the person skilled in the art. Ideally the feedstock enters the radiant section at a temperature just below the point where the pyrolysis reaction starts. If the feedstock inlet temperature is too low, additional heat is required to heat up the feedstock in the radiant section, increasing the heat required to be supplied in the radiant section and the corresponding fuel consumption. If the feedstock inlet temperature is too high the pyrolysis may already start in the convection section 2, which is undesirable, as the reaction is associated with the formation of cokes on the internal tube surface, which cannot be removed easily in the convection section 2 during decoking. An advantage of this inventive cracking furnace system is that fouling by condensation of heavy (asphaltenic) tails is hardly possible in the transfer line exchanger according to the invention.

The transfer line exchanger (TLE) is a heat exchanger arranged to cool down or quench the cracked gas 9. Heating the feedstock in part in the transfer line exchangers, according to the invention, using waste heat of the cracked gas 9 in the transfer line exchanger, instead of heating the feedstock only in the convection section 2, as is done in prior art systems, can allow a furnace efficiency to be increased significantly. The furnace efficiency is the ratio between the heat absorbed by at least one radiant coil 8 for the conversion of the hydrocarbon feedstock 1 to the cracked gas 9 by pyrolysis, which is an endothermic reaction, and the heat released by the combustion process in the combustion zone, based on a lower heating value at 25° C. or 15.6° C.

The hydrocarbon feedstock 1 is preferably naphtha or lighter feeds. Hydrocarbon and dilution steam mixture 6 can be used as the cooling medium to recover the heat from the cracked gas 9. Heavy liquid feed may have the fouling concern on the transfer line exchanger. When cracking heavy liquid feed, dilution steam to hydrocarbon ratio is high. Dilution steam can be used as the cooling medium to recover the heat from the cracked gas 9.

In the radiant section, the heat of cracking has to be provided to convert the hydrocarbon feed into olefins and other high value products. If the flue gas temperature leaving the radiant section has the same temperature as the conventional furnace, due to the flue gas flow rate is reduced by 80%, the heat available in the oxyfuel ethylene cracking furnace convection section is only 20% of the available heat in the conventional furnace. The available heat is not sufficient to raise the hydrocarbon feed and dilution steam to the target crossover temperature.

In the cooling section, the cracking effluent has to be cooled down immediately to stop the secondary reactions and preserve the cracked gas yield. The cooling medium in the conventional furnace is saturated boiler feed water or cold boiler feed water.

The hydrocarbon feedstock 1 and the diluent 3 needs to be further heated and the cracking effluent needs to be cooled. The heat demand and the heat supply are coupled together in the secondary transfer line exchanger 7. The shell and tube exchanger tube side is the cracked gas 9 and the shell side is the hydrocarbon feedstock and diluent mixture 6. The oxyfuel ethylene cracking furnace convection section 2 has the hydrocarbon and diluent preheat banks only. Then the hydrocarbon feedstock 1 and diluent 3 are mixed and routed to the shell side of the secondary transfer line exchanger 7 for super heating. After superheating in the secondary transfer line exchanger 7, the hydrocarbon feedstock and diluent mixture 6 is delivered to the radiant section for cracking.

The primary transfer line exchanger 10 is the traditional boiler feed water quench exchanger. There are no economizer bank for boiler feed water preheating and no super high pressure steam superheating banks in the convection section 2. Boiler feed water is directly brought into the steam drum 12. Super high-pressure steam is generated on the shell side of the primary quench exchanger and exported for superheating or utilization in the plant. The residual heat in the convection section 2 is only utilized to preheat feedstock and diluent.

Depending on the embodiment, the cracking furnace system according to the present invention can comprise one or more of the following features:

- the diluent 3 is dilution steam.
- the surface area of the radiant coil 8 in the radiant section is comprised of serpentine coils; These serpentine coils transfer heat from the heat source such as flame to the heat sink such as hydrocarbon and dilution steam inside the radiant coils 8;
- the cooling section comprises a tertiary transfer line exchanger.
- the radiant section comprises oxyfuel burners.
- The cracking furnace system a flame temperature control device in the radiant section;
- the flame temperature control device comprises high velocity jets 17 to introduce fuel and oxygen or oxygen enriched air 14 in the radiant section. The high velocity jets 17 entrain firebox flue gas with flue gas internal recirculation and reduce fuel and oxygen concentrations in the combustion zone; Modern burner technology utilizes staged fuel and staged oxidant to control the flame temperature. Both fuel and oxygen have high supply pressure. Before mixing fuel and oxygen, fuel jet and oxygen jet can entrain flue gas inside the firebox to dilute the concentration of fuel and oxygen. This is flue gas internal recirculation. Because of such recirculation, fuel and oxygen is diluted before combusted, and thereby the oxyfuel combustion flame temperature is controlled. Thermal NOx is controlled by flue gas recirculation as well.
- the convection section 2 does not comprise utility banks such as boil feed water economizer bank and super high pressure steam superheating banks configured to generate super-heated steam. Only saturated steam 11 is generated from transfer line exchangers. Thus the flue gas residual heat in the convection section 2 is only utilized to preheat hydrocarbon feed and dilution steam.

The diluent 3 can preferably be steam. Alternatively, methane can be used as diluent instead of steam. The mixture can also be superheated in the convection section 2. This is to ensure that the feedstock mixture does not contain any droplets anymore. The amount of superheat must be enough to make sure that the dew point is exceeded with sufficient margin to prevent condensation of the diluent 3 or the hydrocarbons. At the same time, decomposition of the feedstock and coke formation in the convection section 2, as well as in the transfer line exchanger where the risk of coke formation is still higher due to the higher temperature, can be prevented. Moreover, as the specific heats of both the feedstock-diluent mixture 6 and the cracked gas 9 are very similar, the resulting heat flows are also similar on both sides of the walls of the heat exchanger, i.e. the transfer line exchanger. This means that the heat exchanger can run with practically the same temperature difference throughout the exchanger from cold side to hot side. This is advantageous both from a process point of view as from a mechanical point of view.

The firebox can preferably be configured such that a firebox efficiency is higher than 50%, preferably higher than 60%, more preferably higher than 70%. The firebox efficiency is the ratio between the heat absorbed by the at least one radiant coil 8 for the conversion of the hydrocarbon feedstock 1 to the cracked gas 9 by pyrolysis and the heat released by the combustion process. A normal firebox efficiency of prior art cracking furnaces lies around 40%. If we go above this, the feedstock can no longer be heated up to the optimum temperature as insufficient heat is available in the flue gas: increasing the firebox efficiency from around 40% to approximately 48% would reduce the fraction of the heat available in the convection section 2 from approximately 50-55% to approximately 42-47%. Contrary to prior art systems, the system according to the invention can cope with this reduced availability of heat in the convection section 2. By raising the firebox efficiency with approximately 20% from around 40% to approximately 48%, approximately 20% of fuel can be saved. Firebox efficiency can be raised in different ways, for example by raising the adiabatic flame temperature in the firebox and/or by increasing the heat transfer coefficient of the at least one radiant coil 8.

The at least one radiant coil 8 of the firebox preferably includes a highly efficient radiant tube, such as the swirl flow tube, as disclosed in EP1611386, EP2004320 or EP2328851, or the winding annulus radiant tube, as described in UK 1611573.5. More preferably, said at least one radiant coil 8 has an improved radiant coil lay-out, such as a three-lane lay-out, as disclosed in US2008142411.

As shown in FIG. 1, the cracking furnace system 100 for converting the hydrocarbon feedstock into cracked gas is provided. The cracking furnace system 100 includes, a first flow path 101 (represented by the hashed line) for flowing the hydrocarbon feedstock 1 through the cracking furnace and a second flow path 103 for flowing the diluent 3 through the cracking furnace.

The convection section 2 is disposed in the first flow path 101 and the second flow path 103 and is configured to receive only the hydrocarbon feedstock 1 and the diluent 3 to preheat the hydrocarbon feedstock and the diluent. The mixing device 16 is disposed in the first flow path 101 and the second flow path 103 at a junction 105, downstream of the convention section 2, configured and adapted to mix the preheated hydrocarbon feedstock and the preheated diluent to generate the feedstock-diluent mixture 6.

The radiant section 18 is disposed in the first flow path 101 downstream of the mixing device 16, the radiant section 18 having a firebox, the firebox comprising one or more pure oxygen burners and a plurality of serpentine radiant coils (e.g., coil 8) configured to heat the feedstock-diluent mixture 6 to a temperature allowing a pyrolysis reaction. The cooling section can include a first transfer line exchanger 10 in at least the first flow path 101 and a second transfer line exchanger 7 is also provided in at least the first flow path 101.

The first transfer line exchanger 10 is disposed in the first flow path downstream of the radiant section 18, and the second transfer line exchanger 7 is disposed in the first flow path 101 upstream of the radiant section 18 and downstream of the radiant section 18 such that the feedstock-diluent mixture 6 is preheated in the second transfer line exchanger 7 with cracked gas 9 exiting the radiant section 18 before the feedstock-diluent mixture 6 enters into the radiant section 16. At the same time, the cracked gas 9 exiting the radiant section 18 is cooled with the feedstock-diluent mixture 6 in the second transfer line exchanger 7.

The cracking furnace system 100 further includes a third flow path 107 for flowing steam within the cracking furnace 100. The first transfer line exchanger 10 is disposed in the third flow path 107 and the first flow path 101 for generating steam, e.g., via the exchange of heat between the cracked gas 9 and boiler fee water BFW. The steam drum 12 is disposed in the third flow 107 path for receiving steam 11 from the first transfer line exchanger 10. In certain embodiments, there is no boiler feed water bank in the convection section 2, e.g., as shown. As such, the boiler feed water BFW can be provided directly to the steam drum 12 via the third flow path 107 and wherein steam 11 produced at the first transfer line exchanger 10 is provided directly to the steam drum 12 via the third flow path 107.

Another object of the present invention is a for cracking hydrocarbon feedstock 1 in a cracking furnace system according to the present invention, the method comprising:

a) A feedstock preheating step in the convection section 2 at a temperature between 50° ° C. and 180° C., preferably at a temperature between 150° C. and 160° C.,
b) A mixing step of the hydrocarbon feedstock 1 preheated at the step a) with a diluent 3 to form a mixture feedstock-diluent 6,
c) A preheating step of the mixture feedstock-diluent 6 in the secondary transfer line exchanger 7 at a temperature between 250° C. and 700° C., preferably at a temperature between 275° C. and 500° ° C.,
d) A cracking step of the mixture preheated at step c) in the radiant section by oxygen or oxygen enriched air 14 combustion to produce cracked gas 9
e) A first cool step of the cracked gas 9 in the primary transfer line exchanger (PTLE) 10,
f) A second cool step of the cracked gas 9 exiting the primary transfer line exchanger (PTLE) 10 in the secondary transfer line exchanger (STLE) 7, and
g) A production step of a saturated super high-pressure steam in the primary transfer line exchanger 10.

Depending on the embodiment, the method according to the present invention can comprise one or more of the following features:

the saturated super high-pressure steam produced at step g) is generated from water coming from steam drum 12.
the saturated super high-pressure steam produced at step g) is sent into the steam drum 12.
the diluent 3 is dilution steam.
the dilution steam is produced outside the cracking furnace system.
the step d) comprises a controlling sub-step of the combustion temperature in the radiant section by dilution of fuel and oxygen or oxygen enriched air 14, preferably with the internally recirculated flue gas.
the oxygen enriched air comprises more than 21% oxygen.
at the cracking step d) flue gas is produced at a temperature between 950° C. and 1300° C., preferably at a temperature between 1000° C. and 1150° C., and sent to the convection section 2.

As shown in FIG. 1, a cracking furnace system according to an embodiment of the invention includes a convection section 2 including a plurality of convection banks. Hydrocarbon feedstock 1 can enter a feed preheater, which can be one of the plurality of convection banks in the convection section 2 of the cracking furnace system. This hydrocarbon feedstock 1 can be any kind of hydrocarbon, preferably paraffinic or naphthenic in nature, but small quantities of aromatics and olefins can also be present. Examples of such feedstock are: ethane, propane, butane, natural gasoline, naphtha, kerosene, natural condensate, gas oil, vacuum gas oil, hydro-treated or desulphurized or hydro-desulphurized (vacuum) gas oils or combinations thereof. The diluent 3, such as dilution steam, can be preheated too in the convection section 2. The preheated feedstock 4 is mixed with the preheated diluent 5. The feedstock/diluent mixture 6 is preheated in the secondary transfer line exchanger 7 to reach an optimum temperature for introduction into the radiant coil 8.

The radiant coil 8 can for example be of the swirl flow type, as disclosed in EP1611386, EP2004320 or EP2328851, or a three lane radiant coil design (as disclosed in US 2008 142411), or a winding annulus tube type (UK 1611573.5) or of any other type maintaining a reasonable run length, as known to the person skilled in the art. In the radiant coil 8 the feedstock/diluent mixture 6 is quickly heated up to the point where the pyrolysis reaction starts so that the hydrocarbon feedstock is converted into products and by-products. Such products are amongst others hydrogen, ethylene, propylene, butadiene, benzene, toluene, styrene and/or xylenes. By-products are amongst others methane and fuel oil. The resulting mixture of a diluent such as dilution steam, unconverted feedstock and converted feedstock 9, which is the reactor effluent called "cracked gas", is cooled quickly in the primary transfer line exchanger 10 then in the secondary transfer line exchanger 7, to freeze the equilibrium of the reactions in favor of the products. In a first inventive way, the waste heat in the cracked gas 9 is first recovered in the primary transfer line exchanger 10 by generating saturated steam 11 from water from steam drum 12. The saturated steam 11 can be sent to the steam drum 12. The saturated super high pressure is exported 15. In a second inventive way, the waste heat in the cracked gas 9 is second recovered in the secondary transfer line exchanger 7 by heating up the feedstock-diluent mixture 6 before it is sent to the radiant coil 8.

The heat of reaction for the highly endothermic pyrolysis reaction can be supplied by the combustion of fuel gas 13 in the radiant section 18, also called the furnace firebox, in many different ways, as is known to the person skilled in the art. Oxygen or oxygen enriched air 14 can for example be introduced directly into burners of the furnace firebox, in which burners fuel gas 13 and oxygen or oxygen enriched air 14 is fired to provide heat for the pyrolysis reaction. In the furnace firebox, fuel gas 13 and oxygen or oxygen enriched air 14 are converted to combustion products such as water and CO2, the so-called flue gas. The waste heat from the flue gas is recovered in the convection section 2 using various types of convection banks. Part of the heat is used for the preheating hydrocarbon feedstock and/or the diluent 3.

In summary, the present invention has the following advantages:

- Combustion oxidant can be pure oxygen or oxygen enriched air 14. Inert gas presence in the furnace is minimized without any additional inert gas injection or external recirculation.
- The oxyfuel ethylene cracking has a unique heat integration. Convection section 2 only consists of hydrocarbon feed and dilution steam preheat banks. Hydrocarbon feed and dilution steam mix is further super-heated in the transfer line feed effluent exchanger against the cracking effluent. Then the feed and dilution steam is routed to the radiant section for cracking reactions.
- Boiler feed water preheat and super high pressure steam banks are removed from the convection section 2. Boiler feed water is directly supplied to the steam drum 12. Saturated super high-pressure steam is exported.
- Oxyfuel burner is used in the firebox to deliver the heat. Flue gas mass flow rate is reduced by more than 80%. Flue gas mainly contains carbon dioxide and water from the combustion. Oxygen and fuel are staged in the oxyfuel burner to control heat flux profile and NOx emission.

The invention claimed is:

1. A cracking furnace system for converting a hydrocarbon feedstock into cracked gas, the cracking furnace system comprising:

a convection section;

a radiant section;

a cooling section, wherein the convection section includes a plurality of convection banks configured to receive only a hydrocarbon feedstock and a diluent, wherein the radiant section includes a firebox comprising at least oxygen or oxygen enriched air burners and several radiant coils configured to heat up the feedstock to a temperature allowing a pyrolysis reaction, wherein the cooling section includes at least two transfer line exchangers (TLE): a primary transfer line exchanger (PTLE) and a secondary transfer line exchanger (STLE), wherein the system is configured such that the secondary transfer line exchanger is configured to exchange heat between a hydrocarbon feedstock and diluent mixture received from the convection section and cracked gas received from the first transfer line exchanger to preheat the hydrocarbon feedstock and diluent mixture before entry into the radiant section, wherein the primary transfer line exchanger is configured to exchange heat between cracked gas received from the radiant section and a cooling fluid to quench the cracked gas to generate saturated steam; and a steam drum which is connected to the primary transfer line exchanger.

2. The cracking furnace system according to claim 1, wherein the diluent is dilution steam.

3. The cracking furnace system according to claim 2, wherein the surface area of the radiant coil in the radiant section is comprised of serpentine coils.

4. The cracking furnace system according to claim 1, wherein the cooling section comprises a tertiary transfer line exchanger.

5. The cracking furnace system according to claim 1, wherein the radiant section comprises oxyfuel burners.

6. The cracking furnace system according to claim 1, further comprising a flame temperature control device in the radiant section.

7. The cracking furnace system according to claim 6, wherein the flame temperature control device comprises high velocity jets to introduce fuel and oxygen or oxygen enriched air in the radiant section.

8. The cracking furnace system according to claim 1, wherein the convection section does not comprise one or more of a boil feed water economizer bank and/or a super high pressure steam superheating bank configured to generate super-heated steam.

9. The cracking furnace system according to claim 1, wherein the convection section is configured to heat the feedstock to a temperature between 150° C. and 160° C.

10. The cracking furnace system according to claim 1, wherein the secondary transfer line exchanger is configured to heat the feedstock and diluent to a temperature between 275° C. and 500° C.

11. The cracking furnace system according to claim 1, wherein a firebox efficiency is 50% or greater, wherein the firebox efficiency is defined as a ratio between heat absorbed by the several radiant coils and the heat released by combustion.

12. The cracking furnace system according to claim 11, wherein the firebox efficiency is greater than 60%.

13. The cracking furnace system according to claim 12, wherein firebox efficiency is greater than more than 70%.

14. A method for cracking hydrocarbon feedstock in the cracking furnace system of claim 1, the method comprising:

preheating the feedstock in the convection section at a temperature between 50° C. and 180° C.;

mixing the hydrocarbon feedstock after preheating with the diluent to form a mixed feedstock-diluent;

preheating the mixed feedstock-diluent in the secondary transfer line exchanger at a temperature between 250° C. and 700° C.;

cracking the mixed feedstock-diluent after preheating in the radiant section by oxygen or oxygen enriched air combustion to produce cracked gas;

cooling the cracked gas in the primary transfer line exchanger (PTLE);

cooling the cracked gas exiting the primary transfer line exchanger (PTLE) further in the secondary transfer line exchanger (STLE); and producing a saturated super high-pressure steam in the PTLE.

15. A cracking furnace system for converting a hydrocarbon feedstock into cracked gas, the cracking furnace system comprising:

a first flow path for flowing a hydrocarbon feedstock through the cracking furnace;

a second flow path for flowing a diluent through the cracking furnace;

a convection section disposed in the first flow path and the second flow path configured to receive only the hydrocarbon feedstock and the diluent to preheat the hydrocarbon feedstock and the diluent;

a mixing device disposed in the first flow path and the second flow path configured and adapted to mix the preheated hydrocarbon feedstock and the preheated diluent to generate a feedstock-diluent mixture, wherein the mixing device is disposed between the convection section and a second transfer line exchanger;

a radiant section disposed in the first flow path downstream of the mixing device, the radiant section having a firebox, the firebox comprising one or more pure oxygen burners and a plurality of serpentine radiant coils configured to heat the feedstock-diluent mixture to a temperature allowing a pyrolysis reaction; and a cooling section having a first transfer line exchanger and the second transfer line exchanger, wherein the first transfer line exchanger is disposed in the first flow path downstream of the radiant section such that cracked gas exiting the radiant section is quenched via heat exchange with boiler feed water generating steam and quenched cracked gas, and wherein the second transfer line exchanger is disposed in the first flow path upstream of the radiant section and downstream of the first transfer line exchanger such that the feedstock-diluent mixture is preheated in the second transfer line exchanger via heat exchange with the quenched cracked gas exiting the first transfer line exchanger before the feedstock-diluent mixture enters into the radiant section and the quenched cracked gas exiting the first transfer line exchanger is further cooled with the feedstock-diluent mixture in the second transfer line exchanger.

16. The cracking furnace system according to claim 15, further comprising:

a third flow path for flowing steam within the cracking furnace, wherein the first transfer line exchanger is disposed in the third flow path and the first flow path for generating steam; and a steam drum disposed in the third flow path for receiving steam from the first transfer line exchanger.

17. The cracking furnace system according to claim 15, wherein there is no boiler feed water bank in the convection section.

18. The cracking furnace system according to claim 17, wherein boiler water is provided directly to the steam drum via the third flow path and wherein steam produced at the first transfer line exchanger is provided directly to the steam drum via the third flow path.

* * * * *